US008316493B2

(12) United States Patent
Clearman

(10) Patent No.: US 8,316,493 B2
(45) Date of Patent: Nov. 27, 2012

(54) BAG CLOSURE

(75) Inventor: Joseph H. Clearman, Poulsbo, WA (US)

(73) Assignee: Joseph H. Clearman, Poulsbo, WA (US)

( * ) Notice: Subject to any disclaimer, the term of this patent is extended or adjusted under 35 U.S.C. 154(b) by 320 days.

(21) Appl. No.: 12/623,279

(22) Filed: Nov. 20, 2009

(65) Prior Publication Data

US 2011/0119872 A1 May 26, 2011

(51) Int. Cl.
*B26B 11/00* (2006.01)
*B65D 33/16* (2006.01)

(52) U.S. Cl. ..... 7/158; 24/30.5 R; 30/283

(58) Field of Classification Search ..... 7/158, 110, 7/900, 170; 30/280, 283, 294; 24/30.5 R, 24/30.5 S, 30.5 L
See application file for complete search history.

(56) References Cited

U.S. PATENT DOCUMENTS

| | | | | |
|---|---|---|---|---|
| 521,115 | A | | 6/1894 | Hopper |
| 609,486 | A | | 8/1898 | Wilson |
| 838,852 | A | | 12/1906 | Eckley |
| 1,265,139 | A | | 5/1918 | Tittle, Jr. |
| 1,621,008 | A | | 3/1927 | Fricker |
| 2,266,916 | A | | 12/1941 | Steele |
| 2,814,111 | A | | 11/1957 | Jones |
| 3,550,838 | A | | 12/1970 | Hart |
| 3,613,241 | A | | 10/1971 | Allen |
| 3,678,581 | A | | 7/1972 | Bolduc |
| 3,824,688 | A | * | 7/1974 | Goffe ..... 30/294 |
| D235,127 | S | * | 5/1975 | Grant ..... D8/373 |
| 3,939,533 | A | | 2/1976 | Benepe |
| D264,689 | S | | 6/1982 | Miller |
| 4,414,717 | A | | 11/1983 | Payne |
| D276,596 | S | | 12/1984 | Kisha |
| 4,631,829 | A | | 12/1986 | Schmidt et al. |
| 4,656,697 | A | | 4/1987 | Naslund |
| D299,008 | S | | 12/1988 | Naslund |
| D301,548 | S | | 6/1989 | Weaver |
| 4,847,956 | A | | 7/1989 | Levine |
| 4,887,335 | A | | 12/1989 | Folkmar |
| 5,305,500 | A | * | 4/1994 | Tucker ..... 24/30.5 R |
| 5,329,728 | A | | 7/1994 | Ray |
| 5,379,489 | A | | 1/1995 | Delk et al. |
| D363,453 | S | | 10/1995 | Herdt |
| D375,045 | S | | 10/1996 | Weber et al. |
| 5,598,608 | A | * | 2/1997 | Naslund ..... 24/30.5 R |
| 5,619,775 | A | | 4/1997 | Klinck |
| 5,713,108 | A | | 2/1998 | Solomon et al. |
| 5,737,842 | A | | 4/1998 | Freedman |
| 5,921,601 | A | | 7/1999 | Buckles |
| D423,353 | S | | 4/2000 | Blanchard et al. |
| 6,457,218 | B1 | | 10/2002 | Lawrence |
| 6,578,243 | B1 | * | 6/2003 | Hall ..... 24/30.5 R |
| 6,629,327 | B2 | | 10/2003 | Adams |
| 6,886,982 | B2 | | 5/2005 | Reynolds |
| 7,131,169 | B2 | | 11/2006 | Folkmar |
| 2006/0184187 | A1 | | 8/2006 | Surti |

* cited by examiner

*Primary Examiner* — Hadi Shakeri
(74) *Attorney, Agent, or Firm* — Dylan O. Adams; Graybeal Jackson LLP

(57) ABSTRACT

Systems and methods are provided herein that provide for bag cutting and closure.

12 Claims, 8 Drawing Sheets

BAG CLOSURE

FIELD

This disclosure relates generally to closure devices, and more specifically, to systems and methods for providing a bag cutting and closure device.

BACKGROUND

When opening a bag of food and subsequently using the bag to store the food, it is desirable to seal the bag to prevent oxidation and other spoilage of the food to occur. While some bags may have built-in sealing mechanism, many bags do not. Folding of bags fails to provide an adequate seal, so a bag closure device may be employed.

Bag sealing devices may include various clamps and clips; however, such devices are commonly deficient because they fail to provide an adequate seal, they fail to stay coupled to the bag while sealing, or they are not operable to seal a variety of bags having different shapes, sizes, and thicknesses. Moreover, most bag sealing devices are difficult to apply to a bag and are difficult to pick up when using.

BRIEF DESCRIPTION OF THE DRAWINGS

The present disclosure will be presented by way of exemplary embodiments, but not limitations, illustrated in the accompanying drawings in which like references denote similar elements, and in which.

DESCRIPTION

Illustrative embodiments presented herein include, but are not limited to, systems and methods for providing a bag closure device.

Various aspects of the illustrative embodiments will be described using terms commonly employed by those skilled in the art to convey the substance of their work to others skilled in the art. However, it will be apparent to those skilled in the art that the embodiments described herein may be practiced with only some of the described aspects. For purposes of explanation, specific numbers, materials and configurations are set forth in order to provide a thorough understanding of the illustrative embodiments. However, it will be apparent to one skilled in the art that the embodiments described herein may be practiced without the specific details. In other instances, well-known features are omitted or simplified in order not to obscure the illustrative embodiments.

Further, various operations and/or communications will be described as multiple discrete operations and/or communications, in turn, in a manner that is most helpful in understanding the embodiments described herein; however, the order of description should not be construed as to imply that these operations and/or communications are necessarily order dependent. In particular, these operations and/or communications need not be performed in the order of presentation.

The phrase "in one embodiment" is used repeatedly. The phrase generally does not refer to the same embodiment; however, it may. The terms "comprising," "having" and "including" are synonymous, unless the context dictates otherwise.

Figure 1A:
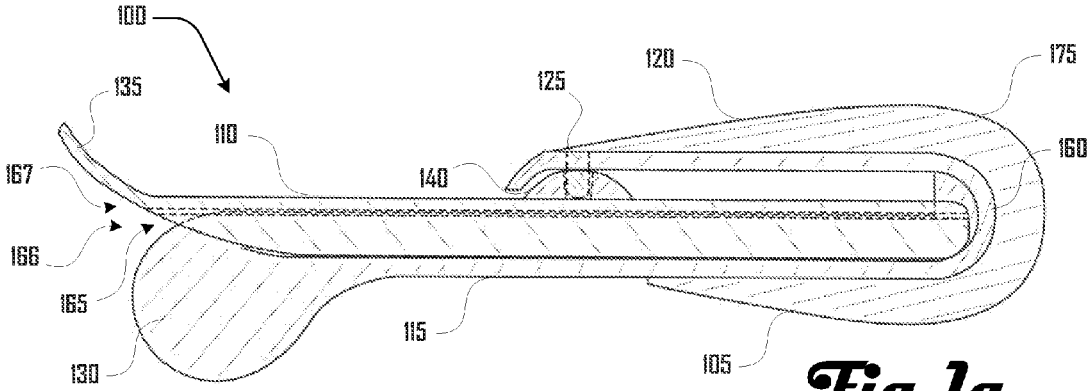
FIG. 1*a* is a side view of a bag closure device in accordance with an embodiment.
Figure 1B:
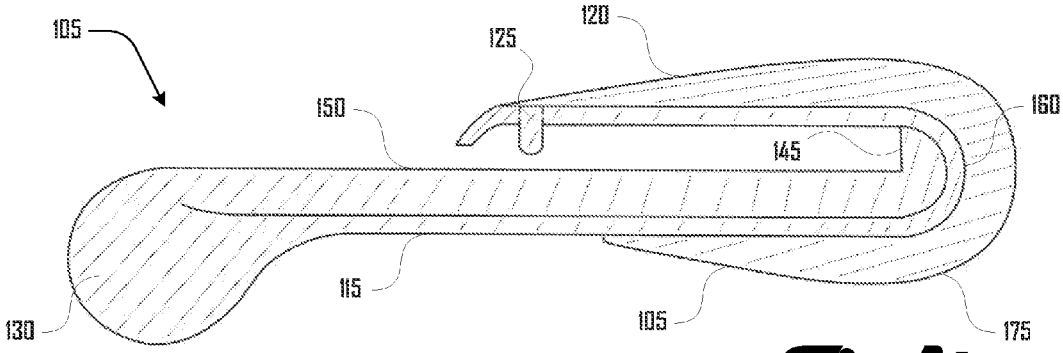
FIG. 1*b* is a side view of a bag closure device architecture in accordance with an embodiment.
Figure 1C:
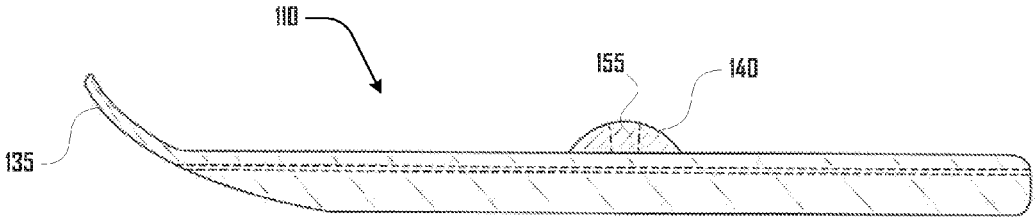
FIG. 1*c* is a side view of a bag closure device pivot bar in accordance with an embodiment.

FIG. 1*a* is a side view of a bag closure device 100 in accordance with an embodiment. As depicted in FIG. 1*a*, the bag closure device 100 comprises a device architecture 105 and a pivot bar 110. FIG. 1*b* depicts a device architecture 105 separated from a pivot bar 110. FIG. 1*c* depicts a pivot bar 110 separated from a device architecture 105.

As depicted in FIGS. 1*a*, 1*b*, and 1*c*, the device architecture 105 includes an upper support arm 120 and a lower holding bar 115 that are coupled at a coupling distal end 160. The upper support arm 120 and lower holding bar 115 encircle the pivot bar 110 and couple thereto via a coupling pin 125. More specifically, the coupling pin 125 of the support arm 120 is operable to reside within a coupling pin orifice 155 in a coupling mound 140 of the pivot bar 110. The coupling mound 140 is centrally located along the length of the pivot bar 110; however, in some embodiments, a coupling mound 140 or other coupling structure may be positioned in various positions along a pivot bar 110.

When coupled to the device architecture 105, the pivot bar 110 rests on a holding rim 150 and abuts a retaining fin 145 at the distal coupling end 160. Additionally, the pivot bar 110 and holding rim 150 define a closure slot 165, which is a receiving entrance 166 at a receiving distal end 167 wherein substrates can be inserted between the pivot bar 110 and the holding rim 150 of the holding bar 115. For example, as shown and described further herein, a bag or other flat substrate can be inserted into the closure slot 165 and held or closed along a length of the pivot bar 110 and the holding rim 150.

In various embodiments the pivot bar 110 is operable to pivot between the holding bar 115 and the support arm 120 and the device architecture 105 is operable to flex about the coupling distal end 160 such that the holding bar 115 and the support arm 120 can move away from each other. Accordingly, when substrates of various thicknesses or folded substrates of various thicknesses are inserted between the holding bar 115 and the pivot bar 110, the pivot bar 110 may pivot to accommodate the substrate. Additionally, various portions of holding bar 115 and holding tension may be generated by the flexing of the device architecture 105, which may occur at or about the coupling distal end 160.

In various embodiments, the device architecture 105 may comprise a spring rib 175, which extends from portions of the coupling distal end 160, the support arm 120, and the holding bar 115. The spring rib 175 may provide for flexing about the coupling distal end 160 in response to substrates being inserted between the holding bar 115 and the support arm 120.

Additionally, a grip 130 may be present on an end of the holding bar 115 and a manipulation extension 135 may be present on an end of the pivot bar 110. The grip 130 and manipulation extension 135 may be used to open the closure slot 165 or may be used to insert a substrate into the closure slot 165 between the holding bar 115 and the pivot bar 110.

Figure 1D:
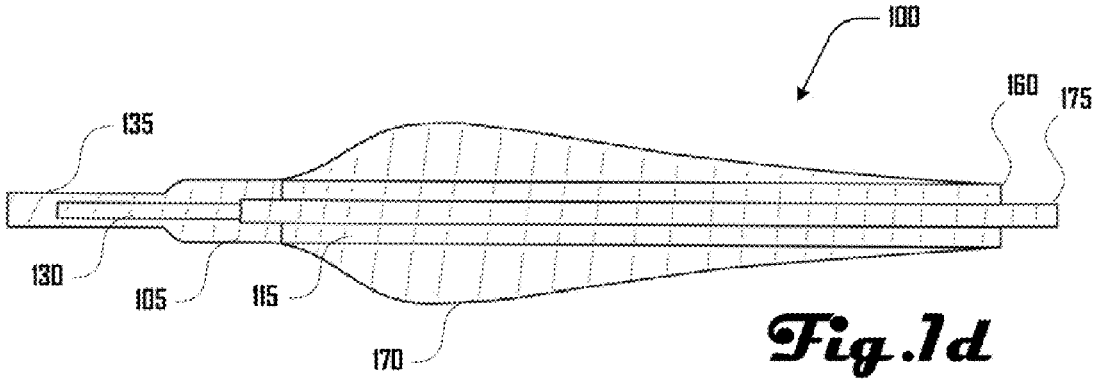
FIG. 1*d* is a bottom view of a bag closure device in accordance with an embodiment.
Figure 1E:
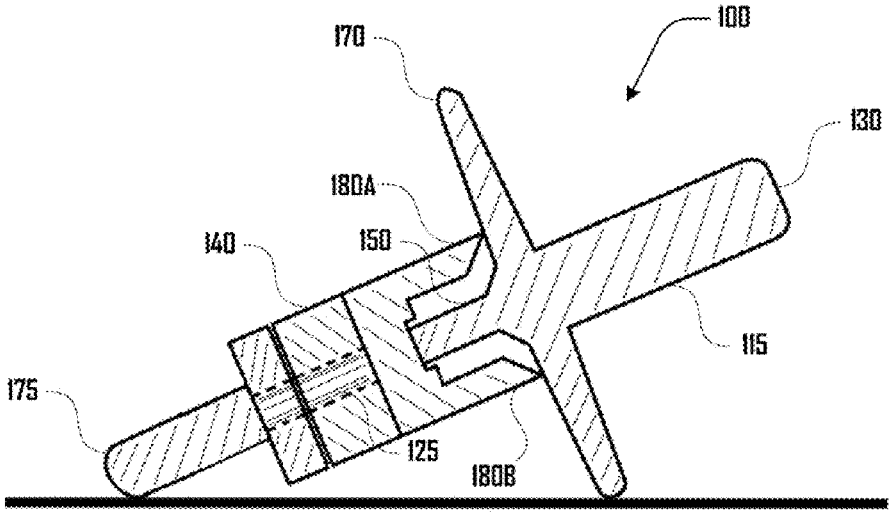
FIG. 1*e* is a cross sectional view of a bag closure device laying on a surface in accordance with an embodiment.

FIG. 1*d* is a bottom view of a bag closure device 100 in accordance with an embodiment, which depicts a bag closure device 100 having a flare 170 along a portion of the device architecture 115. FIG. 1*e* is a cross sectional view of a bag closure device 100 laying on a surface in accordance with an embodiment, and depicts how the flare 170 allows the bag closure device 100 to lay with the grip 130 facing up. Such a configuration may be desirable in various embodiments because the bag closure device 100 can be more easily picked up when the bag closure device 100 is laying flat on a surface. Additionally, given that the flare 170 is present on both sides of the bag closure device 100 in various embodiments, the grip 130 will face upward regardless of which side the bag closure device 100 is laying on.

Figure 1F:
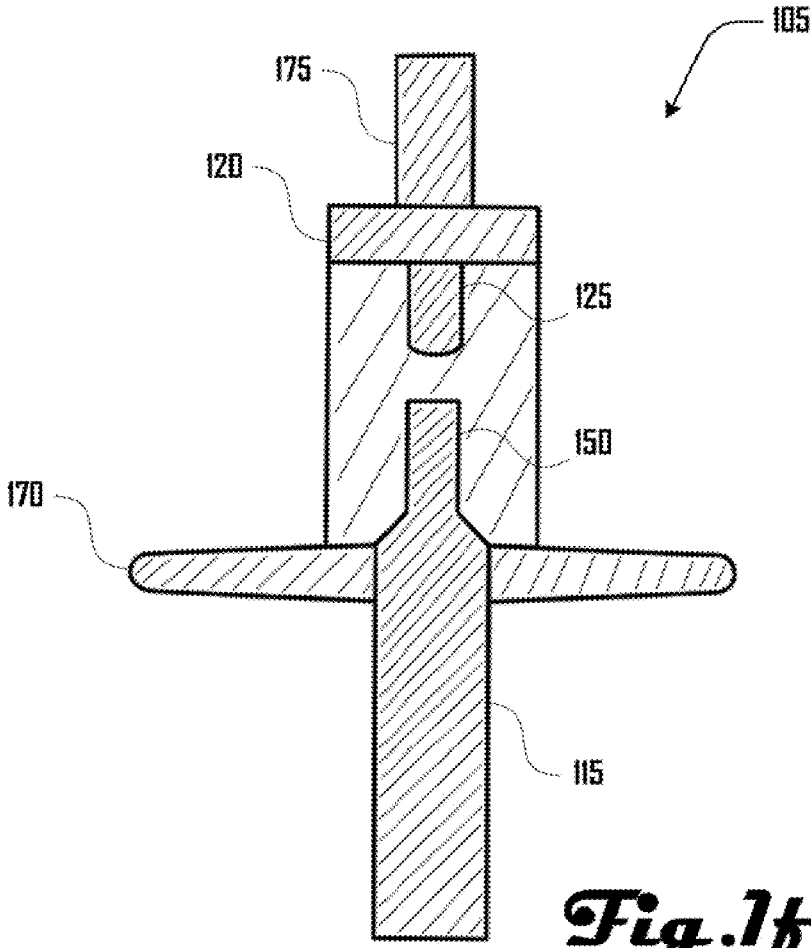
FIG. 1*f* is a cross sectional front view of a bag closure device architecture in accordance with an embodiment.

FIG. 1*f* is a cross sectional front view of a bag closure device architecture 105 in accordance with an embodiment. As depicted in FIG. 1*f*, the bag closure device architecture 105 comprises an upper support arm 120 and a lower holding bar 115. The support arm 120 further comprises a spring rib 175 extending from the top of the support arm 120, and the support arm 120 also comprises a coupling pin 125, which facilitates coupling with the pivot bar 110. The holding bar 115 further comprises a holding rim 150 centrally positioned, and a flare 170 extending perpendicular to the holding rim 150.

Figure 1G:
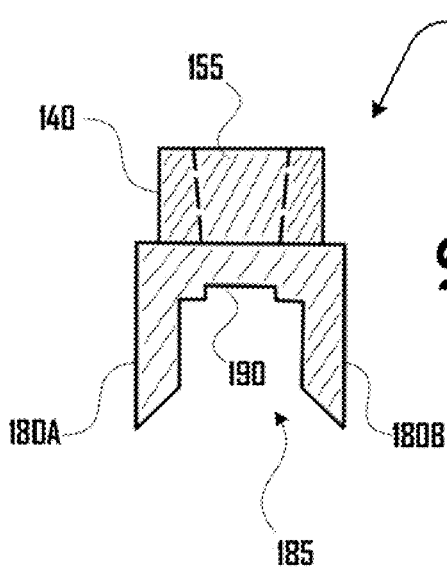
FIG. 1*g* is a cross sectional front view of a bag closure device pivot bar in accordance with an embodiment.

FIG. 1*g* is a cross sectional front view of a bag closure device pivot bar 110 in accordance with an embodiment. The pivot bar 110, as shown in FIG. 1*g*, includes a first and second groove bar 180A, 180B, which define a holding groove 185, and which further define a rim recess 190. The pivot bar 110 may be coupled with a device architecture 105 via coupling pin orifice 155 in a coupling mound 140.

As described further herein, the holding rim 150 is operable to reside within the holding groove 185 and more specifically within the rim recess 190. The fit within the rim recess 190 may be tighter than the fit within the holding groove 185. In various embodiments, there may be a plurality of, or an absence of, any of the holding groove 185 or the rim recess 190.

Figure 1H:
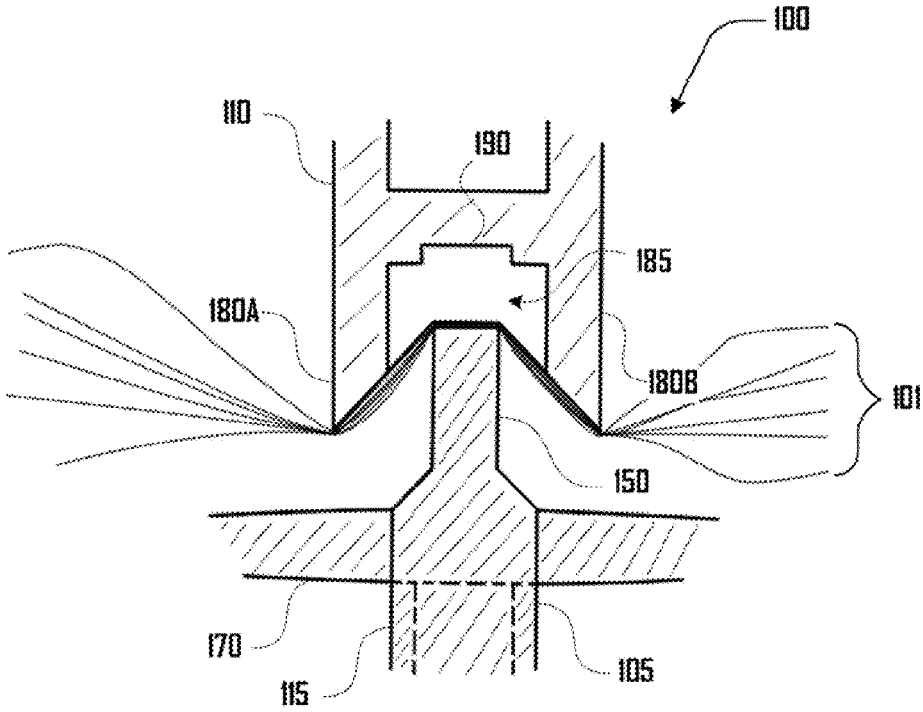
FIG. 1*h* is a cross sectional front view of a bag closure device holding a bag in accordance with an embodiment.
Figure 1I:
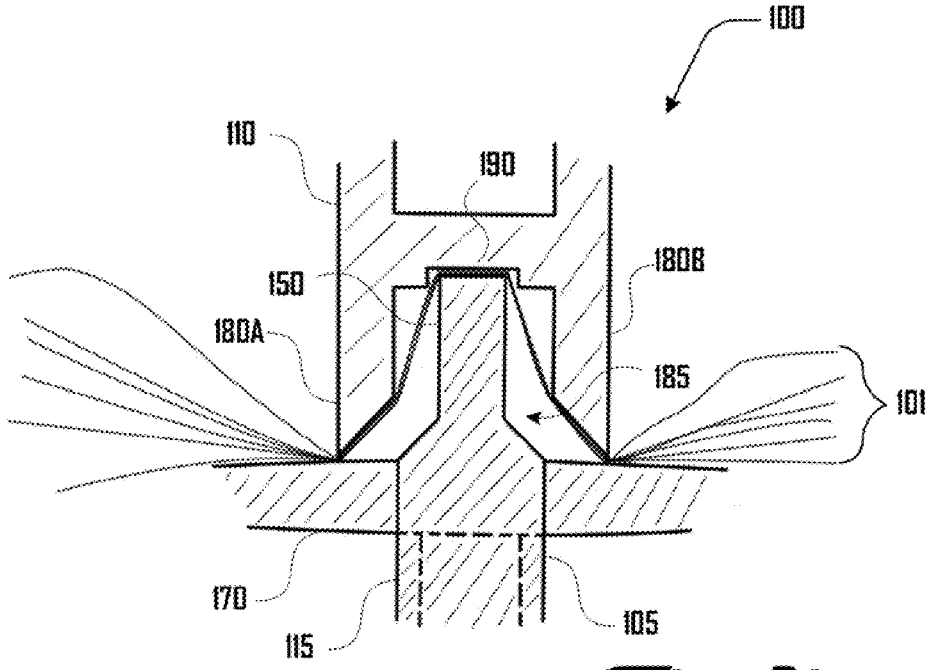
FIG. 1*i* is another cross sectional front view of a bag closure device holding a bag in accordance with an embodiment.

FIGS. 1*h* and 1*i* depict a cross sectional front view of a bag closure device 100 holding a bag 101 in accordance with an embodiment. FIG. 1*h* depicts a configuration of the bag closure device 100 wherein the pivot bar 110 is more separated from the holding bar 115 than the configuration depicted in FIG. 1*i*. In various embodiments, the bag closure device 100 will have a tendency to assume the configuration depicted in FIG. 1*i* because the force exerted on the pivot bar 110 would typically be sufficient to cause the pivot bar 110 to assume a configuration wherein the first and second groove bar 180A, 180B rest on, or nearly rest on the holding rim 150 and/or the flare 170.

However, in various embodiments, the bag closure device 100 may assume a configuration as depicted in FIG. 1*h* when a bag 101 or other substrate is being inserted or removed from between the pivot bar 110 and the holding rim 150, or when certain rigid or thick substrates or bag 101 are being held.

As shown in FIGS. 1*h* and 1*i*, several layers of a bag 101, which may be folded, can be positioned within the holding groove 185 and held by the pivot bar 110 and the holding bar 115. More specifically, as shown in FIG. 1*i*, for example, the bag 101 is held between the pointed ends of the first and second groove bar 180A, 180B and the flare 170 of the holding bar 115. Additionally, the bag 101 also resides within the holding groove 185 and is further held between the holding rim 150 and the rim recess 190.

In various embodiments, the rim recess 190 may be absent, or the rim recess 190 may be various sizes. For example, the rim recess 190 may be larger or smaller than the width of the holding rim 150 in various embodiments. Additionally, in various embodiments, the first and second groove bar 180A, 180B, may be configured in various ways. As shown in FIGS. 1*h* and 1*i*, the groove bars 180A, 180B are pointed and concave; however, the groove bars 180A, 180B may be flat, rounded, or the like in other embodiments.

Furthermore, the holding groove 185 may be various sizes in other embodiments. For example, the holding groove 185 may be deeper, wider, thinner, or shallower than depicted in FIGS. 1*h* and 1*i*, and may be configured based on a differently sized holding rim 150 or the like.

Figure 2A:
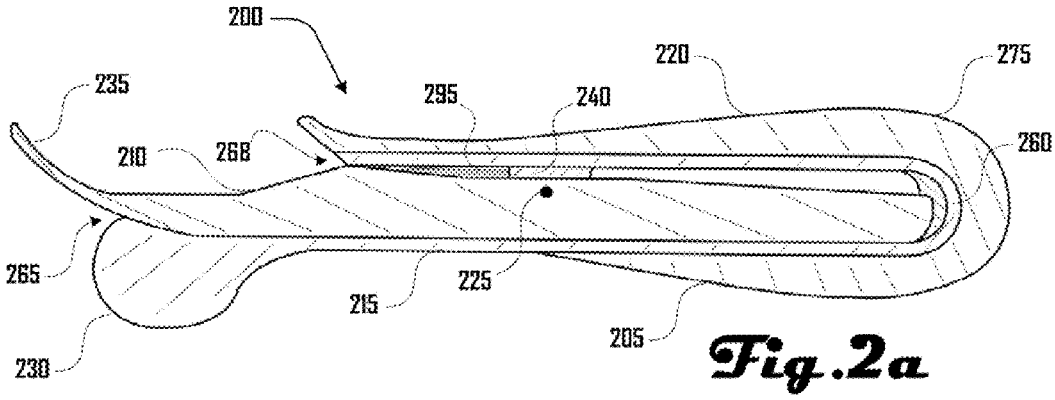
FIG. 2*a* is a side view of a bag closure device in accordance with an embodiment.
Figure 2B:
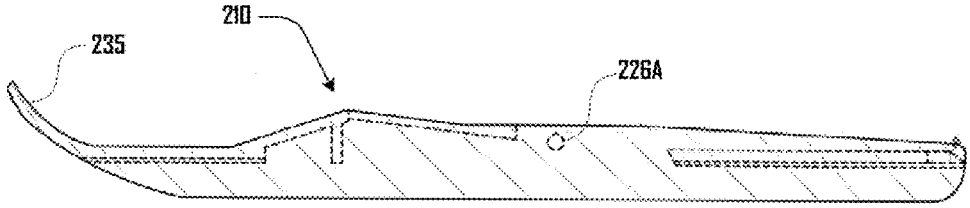
FIG. 2*b* is a side view of a bag closure device pivot bar in accordance with an embodiment.
Figure 2C:
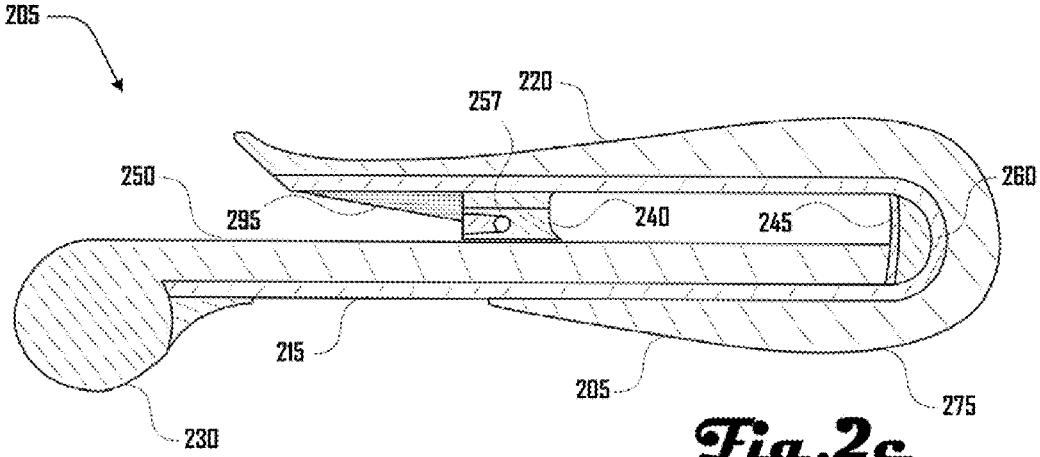
FIG. 2*c* is a side view of a bag closure device architecture in accordance with an embodiment.

FIGS. 2*a-h* depict an alternate bag closure device 200 comprising a cutter enhancement and comprising additional elements that are analogous to the closure device 100 depicted in FIGS. 1*a*-1*i*. FIG. 2*a* is a side view of a bag closure device 200 in accordance with an embodiment, which includes a pivot bar 210 and a device architecture 205. FIG. 2*b* is a side view of a bag closure device pivot bar 210 in accordance with an embodiment. FIG. 2*c* is a side view of a bag closure device architecture 205 in accordance with an embodiment.

As shown in FIGS. 2*a*, 2*b* and 2*c*, the bag closure device 200 includes a device architecture 205 that comprises a support arm 220 and holding bar 215 that are coupled at a coupling distal end 260. Additionally, a spring rib 275 extends from the support arm 220 and holding bar 215.

The support arm 220 also includes a coupling extension 240, which extends from the support arm 220 and is operable to couple with the pivot bar 210 via a coupling orifice 257. In some embodiments, the pivot bar 210 may couple with the coupling extension 240 via a coupling pin 255, which may be a pin that extends through holes in the pivot bar 210 and the coupling orifice 257. In other embodiments, the pivot bar 210 may comprise coupling pins 226A, 226B, which are extended portions of the pivot bar 210, which are operable to reside within the coupling orifice 257 and thereby couple the pivot bar 210 to the coupling extension 240.

Additionally, in various embodiments, the pivot bar 210 may couple to the distal coupling end 260 via a retaining fin 245 as further shown and described herein below. The holding bar 215 also includes a holding rim 250 on which the pivot bar 210 resides when the pivot bar 210 is coupled to the device architecture 205. At a distal end, the junction of the holding rim 250 and the pivot bar 210 defines a closure slot 265, which is a receiving entrance 266 at a receiving distal end 267 through which a bag or other substrate may be inserted between the holding rim 250 and the pivot bar 210.

The pivot bar 210 also includes a manipulation extension 235, and the holding bar 215 includes a grip 230. One or both of the grip 230 and manipulation extension 235 may be used to open or close the closure slot 265 or may be grasped by a user when the user is inserting a bag or other substrate into the closure slot 265.

The bag closure device 200 also includes a cutter slot 268, which is defined by a blade 295 and a portion of the pivot bar 210. As further discussed and illustrated herein, bags and various substrates may be cut within the cutter slot 268.

Figure 2D:
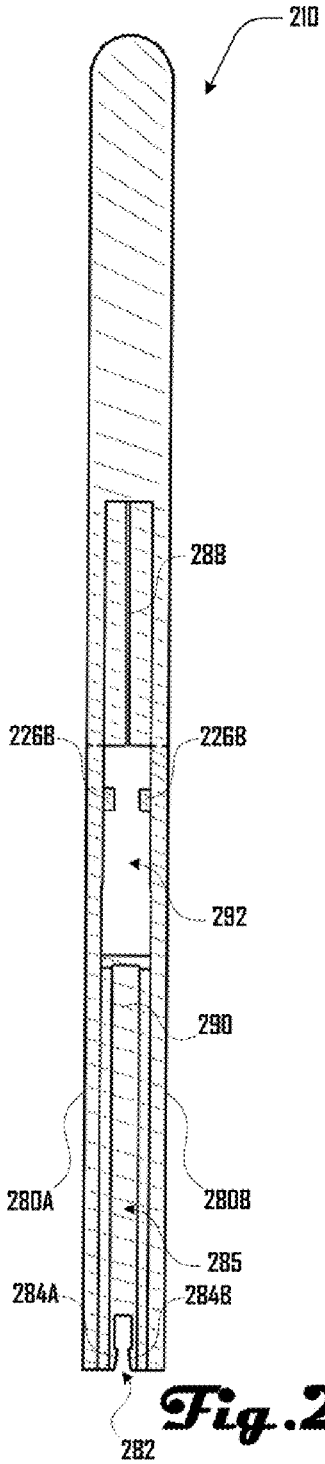
FIG. 2*d* is a bottom view of a bag closure device pivot bar in accordance with an embodiment.
Figure 2E:
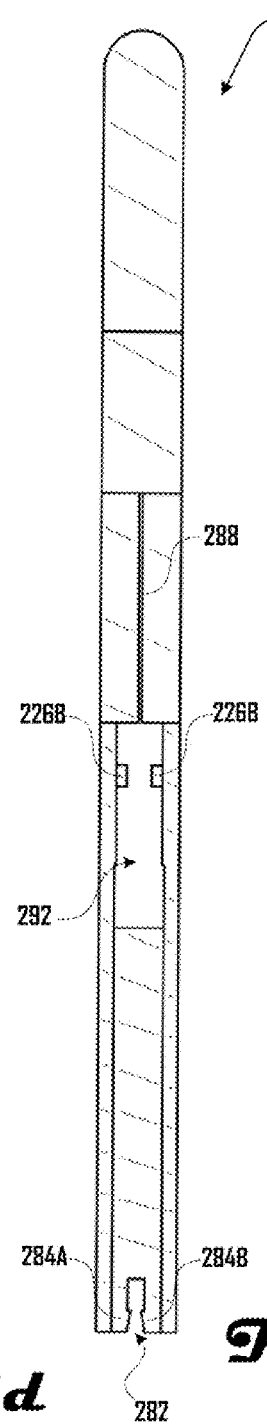
FIG. 2*e* is a top view of a bag closure device pivot bar in accordance with an embodiment.

FIG. 2*d* is a bottom view of a bag closure device pivot bar 210 in accordance with an embodiment and FIG. 2*e* is a bottom view of a bag closure device pivot bar 210 in accordance with an embodiment. Additionally, FIG. 2*f* is a back end view of a bag closure device pivot bar 210 in accordance with an embodiment.

Figure 2F:
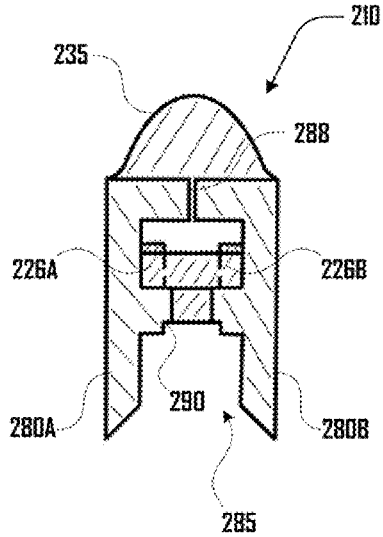
FIG. 2*f* is a back end view of a bag closure device architecture in accordance with an embodiment.

As shown in FIGS. 2*d*, 2*e* and 2*f*, the pivot bar 210 includes a first and second groove bar 280 that define a holding groove 285, and which further define a rim recess 290. In various embodiments, the holding rim 250 of the device architecture 205 is configured to reside within the holding groove 285 and the rim recess 290.

Additionally, the pivot bar 210 also includes a coupling slot 292, which is operable to accept the coupling extension 240 of the device architecture 205. In various embodiments, a first and second coupling pin 226A, 226B may correspond to the coupling orifice 257 on the coupling extension 240, and may thereby couple the pivot bar 210 to the coupling extension 240. In various embodiments, the coupling extension 240 may be under spring tension when it drops into the coupling slot 292, which may thereby act as a retaining mechanism.

In various embodiments, there may be a retaining clip 282 defined by a first and second locking fin 284A, 284B, which is operable to couple with the retaining fin 245. In various embodiments the retaining clip 282 may couple to the retaining fin 245, yet allow the pivot bar 210 to move about the retaining fin 245 when taking on various configurations.

The pivot bar 210 also includes a blade slit 288 in which the blade 295 may reside in various configurations of the cutter slot 268. For example, as the pivot bar 210 pivots about the coupling extension 240 the blade 295 may move in and out of the blade slit 288 to accommodate such movement.

Figure 2G:
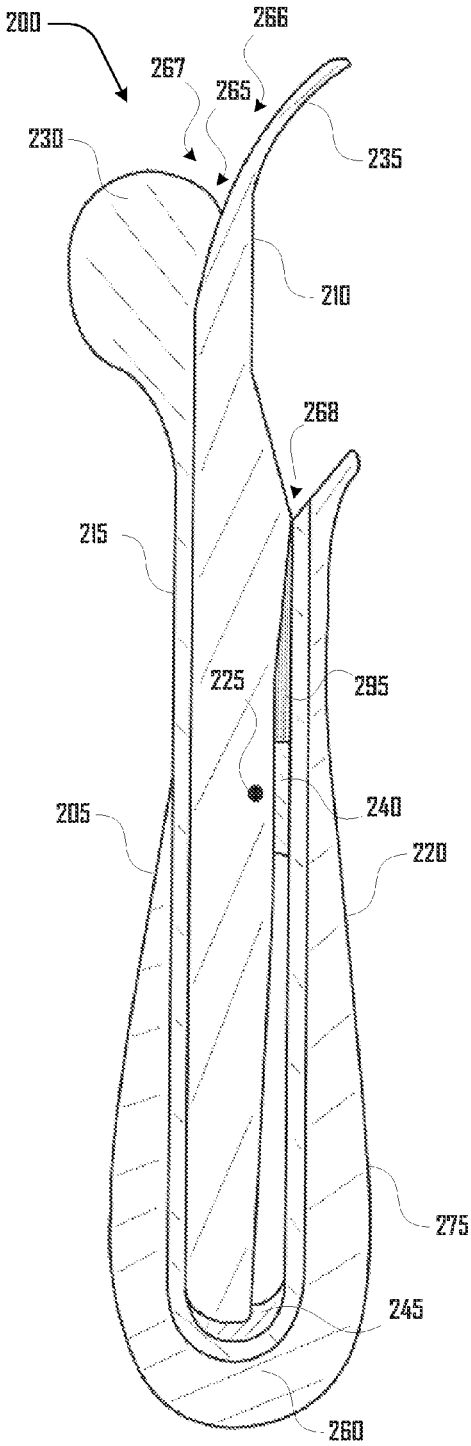
FIG. 2*g* is a side view of a bag closure device in accordance with an embodiment.
Figure 2H:
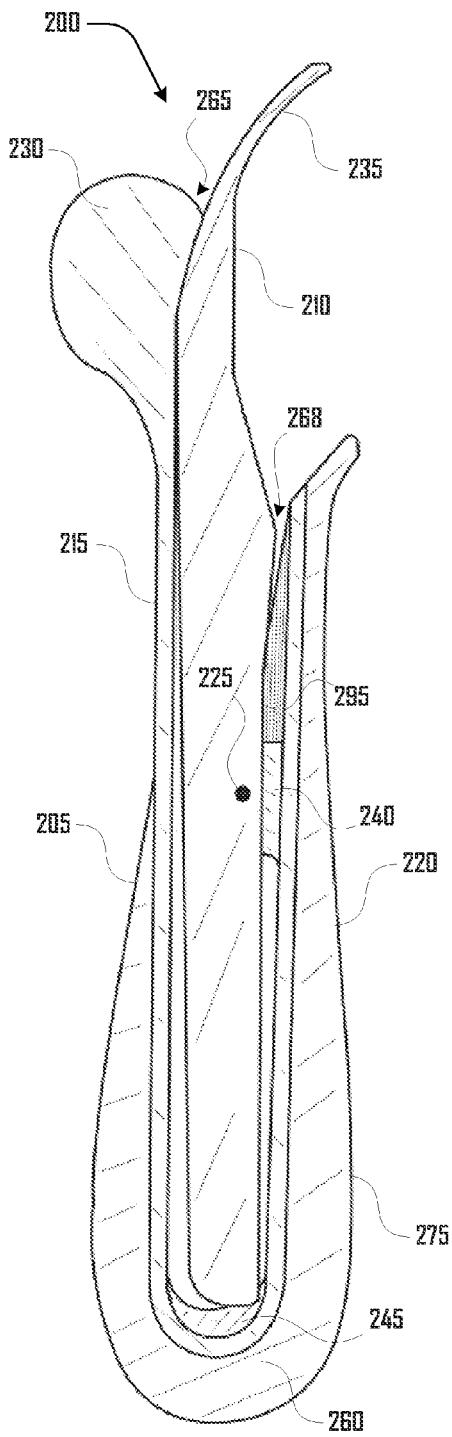
FIG. 2*h* is a side view of a bag closure device in accordance with an embodiment.

FIGS. 2*g* and 2*h* depict two configurations of the pivot bar 210 and the cutter slot 268 in accordance with an embodiment. As shown in FIGS. 2*g* and 2*h* the pivot bar 210 may pivot between the support arm 220 and the holding bar 215 via the coupling pin 225. Accordingly, an end of the pivot bar 210 may move about the retaining fin 245 and the cutter slot 268 may open rearwardly. FIG. 2*h* depicts such an open configuration of the cutter slot 268.

In various embodiments, the cutter slot 268 may open as a result of a substrate being cut within the cutter slot 268. For example, some substrates may be cut in the cutter slot in the cutter slot 268 in the closed configuration depicted in FIG. 2*g*; however, other substrates may require additional force to be cut or be of a thickness that requires the cutter slot 268 to open rearwardly.

The cutter slot 268, in various embodiments, provides resistance to the substrate being forced into the cutter slot, which may cause the pivot bar 210 to move and thereby provide more or less resistance to the substrate 190 being cut. Accordingly, in some embodiments, a reverse-scissoring motion may be created, which may increase cutting efficacy. Substrates, as discussed herein, may be various materials, but may include paper, cardboard, plastic, product containers, metal, and the like.

Figure 3:
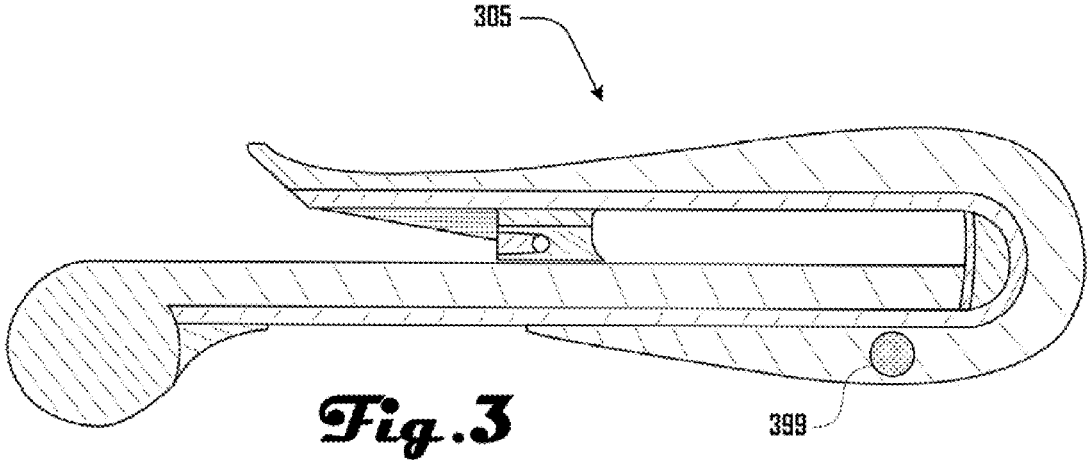
FIG. 3 is a side view of a bag closure device architecture comprising a magnet, in accordance with an embodiment.
Figure 4:
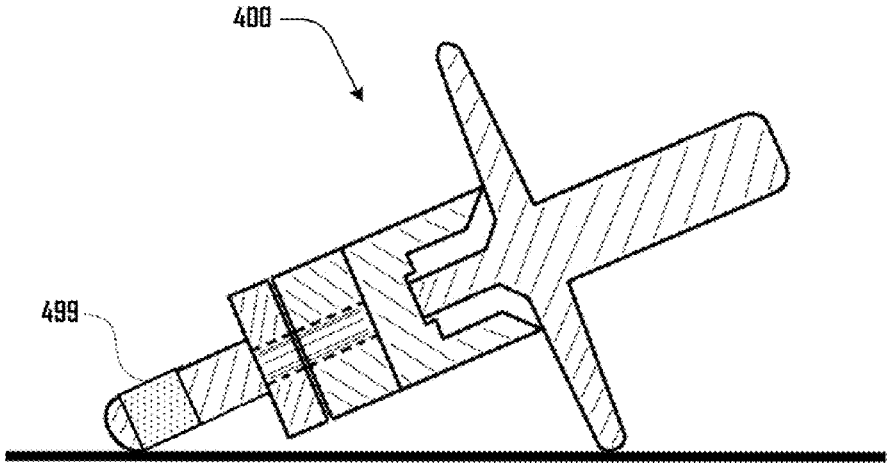
FIG. 4 is a cross sectional view of a bag closure device comprising a magnet and laying on a surface in accordance with an embodiment.

FIG. 3 is a side view of a bag closure device architecture 305 comprising a magnet 399, and FIG. 4 is a cross sectional view of a bag closure device 400 comprising a magnet 499 and laying on a surface in accordance with an embodiment. As depicted in FIG. 4, a magnet 499 may be positioned on the device 400 such that the magnet 499 is proximate to a surface, when the bag closure device 400 is laying on the surface as depicted in FIG. 4.

The positioning of the magnet 499 as depicted in FIG. 4 may be desirable in various embodiments because the bag closure device 400 may thereby couple to a surface that is attracted to the magnet 499 and be easily picked up by a user. For example, the magnet 499 may facilitate coupling of the bag closure device 400 to surfaces of a refrigerator, a magnetic knife rack, a metal substrate, and the like.

In further embodiments, a bag closure device 200, 100 may comprise one or more magnet or other coupling device, which may be positioned as shown in FIGS. 3 and 4, or may be positioned in various other locations on the bag closure device 200, 100. For example, a coupling device may include hook and loop tape, a suction cup, an adhesive, and the like.

Additionally, although specific embodiments have been illustrated and described herein, it will be appreciated by those of ordinary skill in the art and others, that a wide variety of alternate and/or equivalent implementations may be substituted for the specific embodiments shown and described without departing from the scope of the embodiments described herein. This application is intended to cover any adaptations or variations of the embodiments discussed herein. While various embodiments have been illustrated and described, as noted above, many changes can be made without departing from the spirit and scope of the embodiments described herein.

The invention claimed is:

1. A bag closure device comprising:

a first architecture comprising:

an elongated support arm;

an elongated holding bar parallel to and coupled to said support arm at a coupling distal end;

an elongated pivot bar between, and parallel to, said support arm and said holding bar, and engaging a portion of said holding bar and being pivotally coupled with said support arm at a pivot portion of said pivot bar, a cutter comprising a blade; and, wherein the engaged portions of said pivot bar and said holding bar define an elongated closure slot having a receiving entrance at a receiving distal end of said pivot bar and said holding bar;

wherein said receiving entrance is operable to receive a bag and hold said bag in said closure slot;

wherein said cutter is defined by a portion of said support arm and said pivot bar;

wherein said blade is positioned on said support arm;

wherein said pivot bar comprises a blade slot and a portion of said blade is positioned within said blade slot; and, wherein said cutter comprises a cutter slot defined by said cutter blade and a portion of said pivot bar, and said pivot bar is operable to pivot about said pivotal coupling to change the size of said cutter slot.

2. The closure device of claim 1, wherein said coupling distal end is flexible and wherein said closure slot receiving entrance is operable to be expanded when receiving a bag by flexing of said coupling distal end.

3. The closure device of claim 2, wherein said pivot bar comprises an engaging end operable to engage a portion of said coupling distal end, and wherein said closure slot expansion further comprises pivoting of said pivot bar about said engaging end and a holding bar pivotal coupling.

4. The closure device of claim 3, wherein said pivot bar comprises locking fins operable to pivotally couple said pivot bar to a retaining fin on said coupling distal end.

5. The closure device of claim 1, wherein the size of said cutter slot is operable to change when a substrate is received by said cutter slot.

6. The closure device of claim 1, wherein at least one of said pivot bar, said support arm and said holding bar comprises a flare.

7. The closure device of claim 1, wherein at least one of said pivot bar and holding bar comprises one of a grip extension portion and a manipulation extension.

8. The closure device of claim 1, wherein the engaging portion of one of said pivot bar and said holding bar comprises a holding groove;

wherein the engaging portion of one of said pivot bar and said holding bar comprises a holding rim; and wherein said holding rim is operable to reside within said holding groove.

9. The closure device of claim 8, wherein said holding groove and said holding rim define said closure slot.

10. The closure device of claim 8, wherein said holding groove is defined by a pair of parallel elongated groove bars, wherein a portion of the distal end of said groove bars is pointed.

11. The closure device of claim 1, wherein said holding bar and support arm coupling comprises a spring rib extending therefrom.

12. The closure device of claim 1, further comprising a magnet.

* * * * *